United States Patent [19]

Yamada

[11] 4,384,379

[45] May 24, 1983

[54] EXPANSION BED

[75] Inventor: Junji Yamada, Hong Kong, Hong Kong

[73] Assignee: Yamada Co., Ltd., Hong Kong

[21] Appl. No.: 161,029

[22] Filed: Jun. 19, 1980

[30] Foreign Application Priority Data

Dec. 28, 1979 [JP] Japan ..... 54-173911

[51] Int. Cl.[3] ..... A47C 17/64; A47C 19/14

[52] U.S. Cl. ..... 5/115; 5/182; 108/67; 297/106

[58] Field of Search ..... 5/182, 115; 108/67; 297/16, 106

[56] References Cited

U.S. PATENT DOCUMENTS

| | | | |
|---|---|---|---|
| 540,041 | 5/1895 | Blomberg | 5/115 |
| 740,002 | 9/1903 | Freuler | 5/115 |
| 862,346 | 8/1907 | Pihlblad et al. | 5/115 |
| 1,097,100 | 5/1914 | Kallio | 5/115 |
| 2,127,025 | 8/1938 | Graham | 5/182 |
| 3,176,633 | 4/1965 | Balfour | 5/182 |

FOREIGN PATENT DOCUMENTS

| | | | |
|---|---|---|---|
| 529213 | 6/1954 | Belgium | 297/106 |
| 534699 | 3/1922 | France | 5/182 |

*Primary Examiner*—Alexander Grosz
*Attorney, Agent, or Firm*—Sandler & Greenblum

[57] ABSTRACT

An expansion bed which is easily expansible and contractible along its longitudinal direction. The bed comprises a frame having at least two support links on each side which connect front and rear upstanding frame plates. Each of the pairs of support links comprises a support leg which adjustably connects the front and rear frame plates. A plurality of arms are connected to the upper end of the support links and a plurality of mounting plates are positioned upon the support arms for receiving a mattress or other bed surface. The frame plates can be provided with rollers for facilitating movement of the bed and a stopper can be provided for preventing movement of the rollers. If desired, the mounting plates can be placed upon rather than connected to the arms and can be formed so that the widths of adjacent pairs of the plates increase in the longitudinal direction of the bed. Additionally, a cabinet can be provided for placement atop the bed, when in its contracted state, to receive the cushions which do not fold together with the bed frames. Alternately, successive support legs at one end of the frame can increase in length as viewed along the longitudinal direction of the frame. The support legs and arms can be attached as independent units and the bottom portions of support legs at the middle of the frame can be detachable in order that one portion of the frame can be superimposed upon the other portion of the frame.

1 Claim, 41 Drawing Figures

EXPANSION BED

BACKGROUND OF THE INVENTION

1. Technical Field of the Invention

This invention relates generally to an expansion bed and more particularly to an expansion bed which can be expanded and contracted in the longitudinal direction such that it has a substantially reduced size when in its inoperative, contracted position.

2. Discussion of Prior Art

Conventional expansion beds are formed to be expansible and contractible in the longitudinal direction. These beds include a plurality of small bed frames which are foldable in the longitudinal direction and which can be piled or stacked upon each other. Accordingly, the width of these bed frames in their contracted state cannot be less than the width of one of the small bed frames. Furthermore, if the bed frame is divided into a plurality of small bed frames which are foldably interconnected, when piled or stacked these small bed frames will have a relatively greater height and a narrower width than the bed in its expanded state. This is disadvantageous in that such frame dimensions lessen the stability and operability of bed expansion and contraction before and after use.

SUMMARY OF THE INVENTION

It is a general object of the present invention to provide a new and improved expansion bed which can be easily expanded and contracted.

It is an additional object of the present invention to provide a new and improved expansion bed which can be folded into a very compact condition by contracting the bed along its longitudinal direction.

It is a further object of the present invention to provide a new and improved expansion bed which will not have a substantially increased height when it is folded into its contracted position.

Another object of this invention is to overcome all of the above noted defects found in conventional expansion beds.

Upon further study of the specification and appended claims, further objects, features and advantages of the present invention will become more fully apparent to those skilled in the art to which this invention pertains.

Briefly, the above and other objects, features and advantages of the present invention are obtained by providing an expansion bed comprising a frame having spaced front and rear upstanding frame plates and at least one pair of support links. The links of each of said at least one pair are superposed and pivotably secured at a middle portion of the links. Each pair of links comprises a support leg which is adapted to be expanded into a generally X-shaped configuration and contracted into a generally I-shaped configuration. The links span the distance between said front and rear frame plates.

BRIEF DESCRIPTION OF THE DRAWINGS

The above and other objects, features and advantages of the present invention will be more fully apparent to those of ordinary skill in the art to which this invention pertains from the following description, when considered in connection with the accompanying drawings, in which like reference characters designate like or corresponding parts throughout the several views, and wherein.

DETAILED DESCRIPTION OF THE DRAWINGS

This invention relates to a bed comprising a bed frame in which two support links are superposed and pivotably secured to each other at the middle and are adapted to form an expanded, x-shaped support leg and a contracted, I-shaped support leg, respectively. The bed has a plurality of such support legs interconnected to comprise left and right expansion side legs which span the front and rear upstanding bed frame plates. Briefly, this invention permits the entire bed frame to expand and contract in the longitudinal direction of the bed with the left and right side legs expansible and contractible in the horizontal direction.

Figure 1:
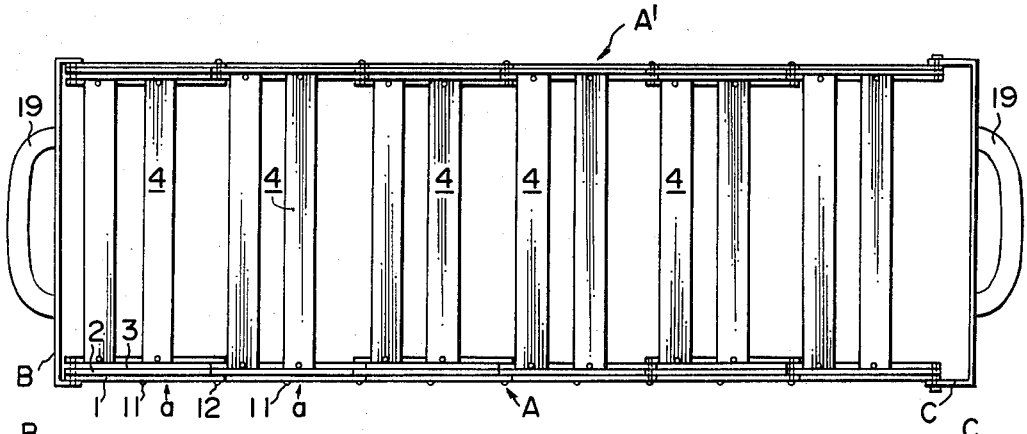
FIGS. 1–3 show a first embodiment of an expansion bed formed in accordance with the present invention, FIG. 1 being a top plan view, FIG. 2 a side plan view, and FIG. 3 a partially enlarged side plan view of the bed.
Figure 2:
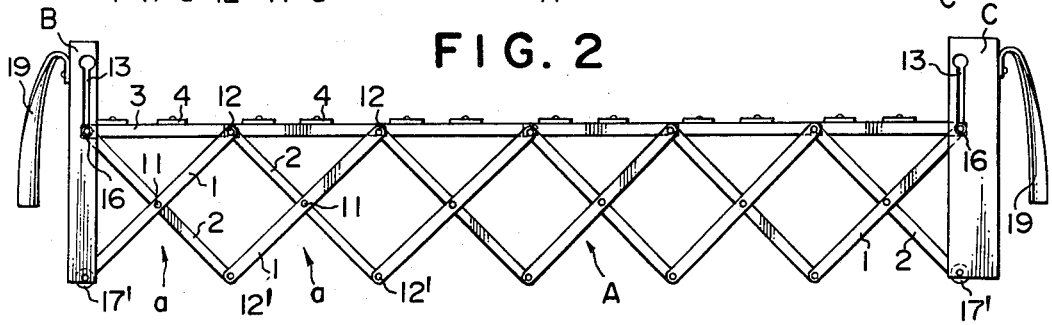
Figure 3:
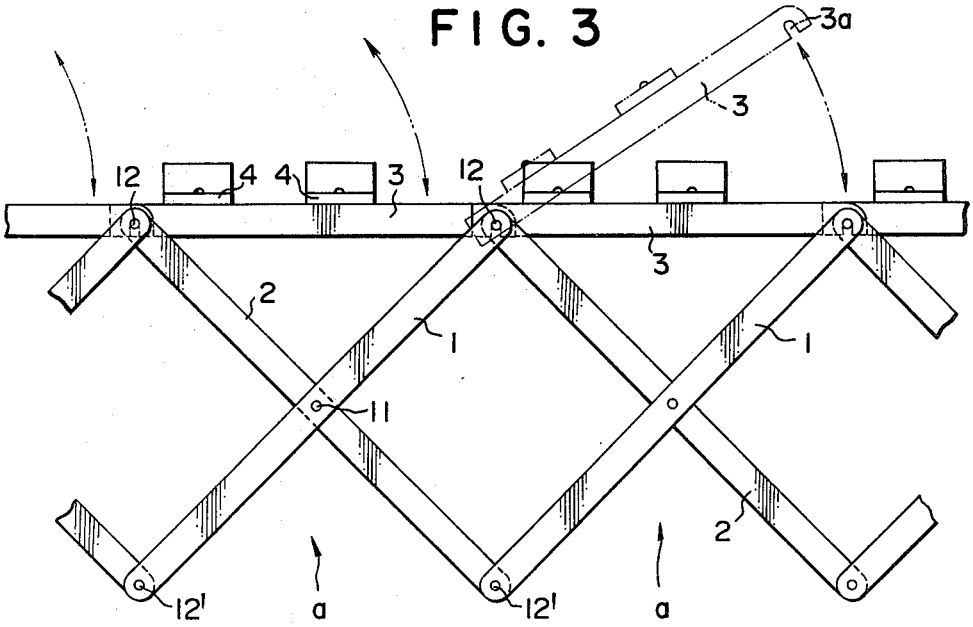

FIGS. 1–3 show a first embodiment of an expansible bed in its expanded, operative position. The bed is provided with support links 1 and 2. These support links are comprised of hard material, e.g., metal, hard synthetic resin, plywood, etc. Each link includes an upper, middle and lower portion. A plurality of support legs (a) are formed by the support links. The links in each pair are superposed and pivotably secured to each other at their middle portions by pins 11. Legs (a) have either an X-shaped or I-shaped configuration, dependent upon whether the bed is in its expanded or contracted state, respectively. Each support link 1 of a given support leg (a) is also pivotably secured to a support link 2 of an adjacent support leg by pin 12, at its upper portion, or pin 12', at its lower portion. Such arrangement of attached support legs comprise the left and right side legs A and A' of the frame. Accordingly, side legs A and A' as a whole can be adjustably expanded and contracted over their entire length since each support leg (a) is capable of being expanded or contracted in X-shaped or I-shaped manner, respectively.

A pivoting portion of a first arm 3 and a latched portion of a second arm 3 are supported by each pin 12, which interconnects upper portions of support legs (a). Left and right side legs A and A' are provided at both of their ends with front and rear upstanding frame plates B and C. These frame plates include vertical guide slots 13 along the upper portions of their side surfaces. These slots retain engaging pins 16, provided at the upper end of support links 1 and 2, on the upper portion of both ends of side legs A and A', as illustrated in FIG. 2. The upper end of each support link 1 or 2 located at the end of side legs A and A' moves upwardly and downwardly within guide slots 13 in order to contract and expand the side legs. Furthermore, left and right pins 12', which interconnect the lower portion of the respective support legs (a) comprising the side leg, are connected to each other by a connecting rod (not shown) to maintain the spacing between the left and right side legs and to continually prevent these legs from diverging or converging.

Figure 4:
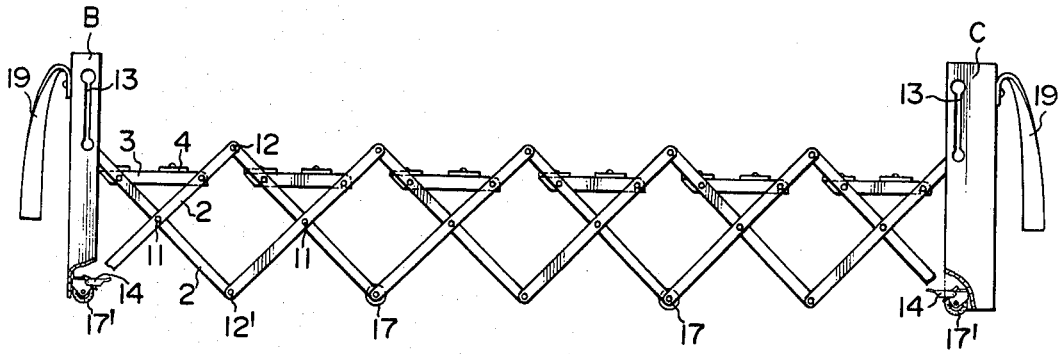
FIGS. 4–6 illustrate a second embodiment of the expansion bed, FIG. 4 being a side plan view, FIG. 5 a top plan of a stopper used with this bed and FIG. 6 a side plan view of the stopper.
Figure 5:
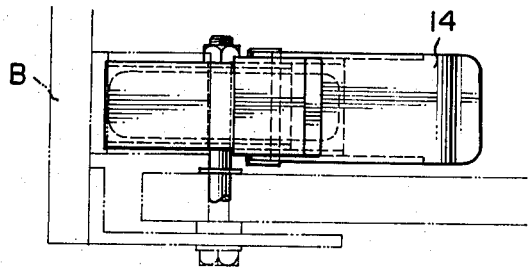
Figure 6:
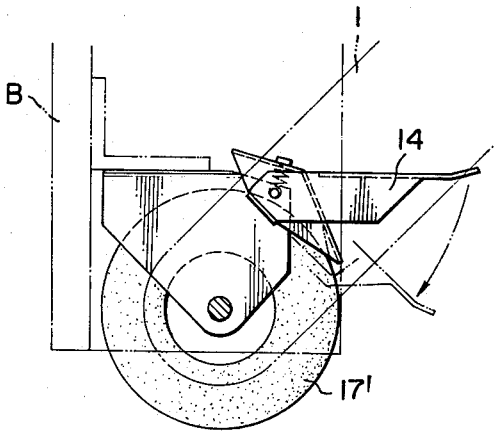

Rollers 17 at the bottom of the support legs and rollers 17' at the base of the frame plates facilitate the expansion and contraction of side legs A and A'. Rollers 17' are provided at the bottom of each of the front and rear erect frame plates and may be provided with stoppers 14 to prevent the rollers from rotating, as illustrated in FIGS. 4–6. Thus, the entire length of side legs A and A' can be conveniently fixed and set to a desired length by operatively mounting stoppers 14 on rollers 17'. The support legs (a) span the entire distance between the frame plates and are connected to the plates, irrespective of the size of the arms.

The length of each arm 3 is sufficient to extend between and span the upper portion of the left and right support links 1 and 2 of each support leg (a) when these support legs are expanded into an X-shaped configuration. The width of the side face of each arm facing the inside of support link 2 is equal to or less than the width of the support link.

Figure 11:
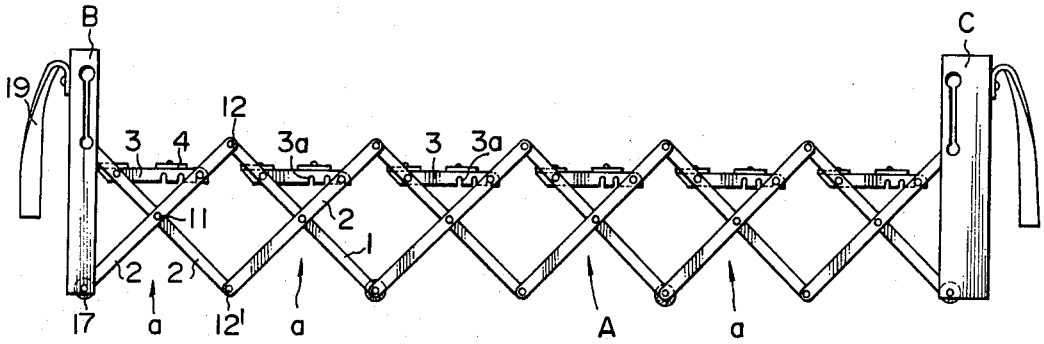
FIGS. 11 and 12 show a fourth embodiment of the bed, FIG. 11 being a side plan view and FIG. 12 a partially enlarged side plan view of the bed.
Figure 12:
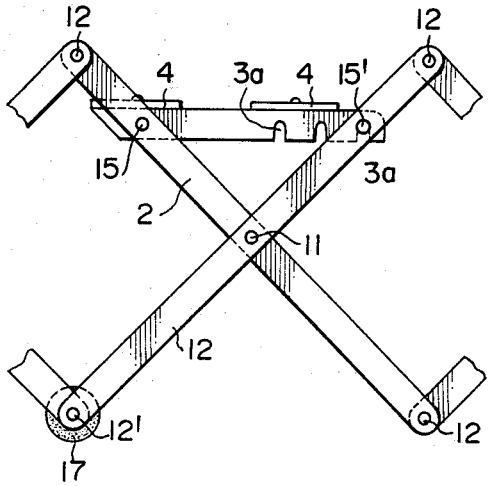

Each arm 3 has a latching notch **3*a* at its lower edge at one end and is pivotably secured at its other end to interconnecting pin 12 so that notch 3*a* can be latched onto another pin. In this manner support legs (a), when expanded in X-shaped fashion, are held in position by arms 3, which respectively latch pins 12. Additionally, when a plurality of notches 3*a* are provided along the lower edge of each arm 3 at a predetermined interval, as shown in FIGS. 11 and 12, the height as well as the total length of the X-shaped expanded support legs (a) can be conveniently changed as desired. Furthermore, the use of notches 3*a* prevents the X-shaped expanded support legs (a) from expanding and contracting, so that predetermined lengths of side legs A and A' can be maintained without requiring stopper 14 to prevent roller 17** from moving.

Side arm 3 can alternately be pivotably secured at one end to a middle portion of support link 2 by pin 15 and latched at its other end on latching pin 15', which is provided on the middle portion of an adjacent support link 1, as seen in FIGS. 4 and 11–17. Positioning arms 3 on the middle of support legs (a) permits portions of support links 1 and 2 located between the upper portion of support legs (a) and the mounting portions of arm 3 to support mats or mattresses 5, 5' or other similar surfaces. This eliminates the possibility of the mats dropping out of the bed frame. This desirable result occurs because left and right arms 3 are spanned by plate 4, on which mats or similar surfaces are mounted, so that the mats fit between the upper ends of support links 1 and 2 on both the left and right side legs A and A'.

Figure 7:
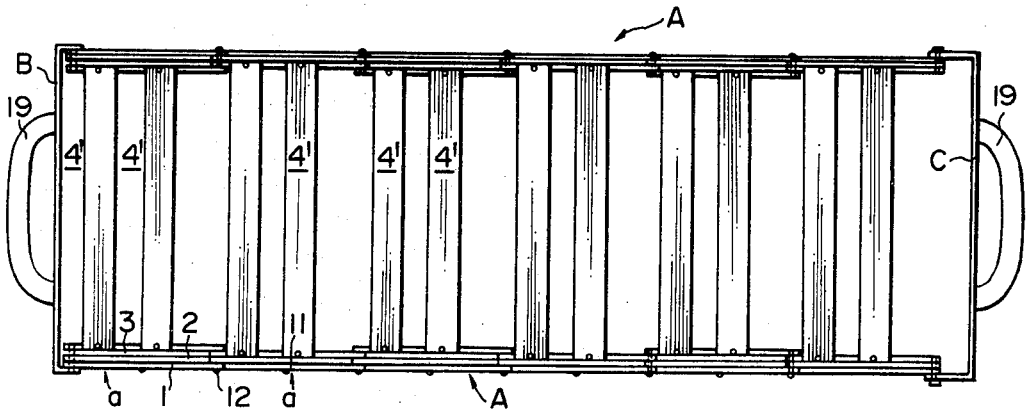
FIGS. 7–10 show a third embodiment of the bed, FIG. 7 being a top plan view, FIG. 8 a side plan view, FIG. 9 a partially enlarged side plan view and FIG. 10 a side view of the bed of FIGS. 7–9 being contracted into its inoperative, contracted position.
Figure 8:
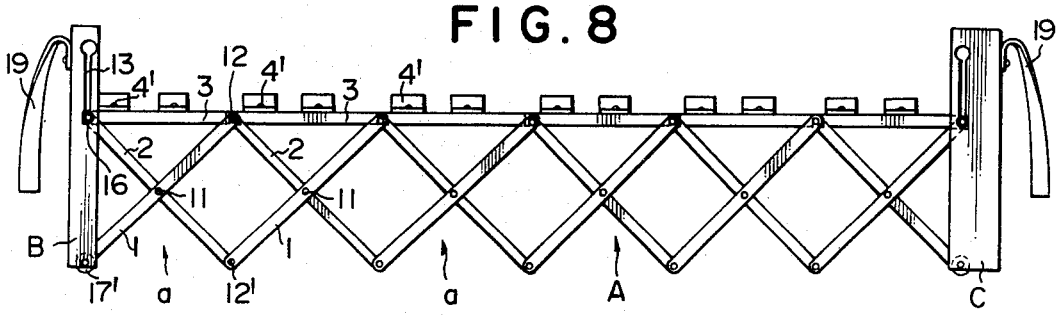
Figure 9:
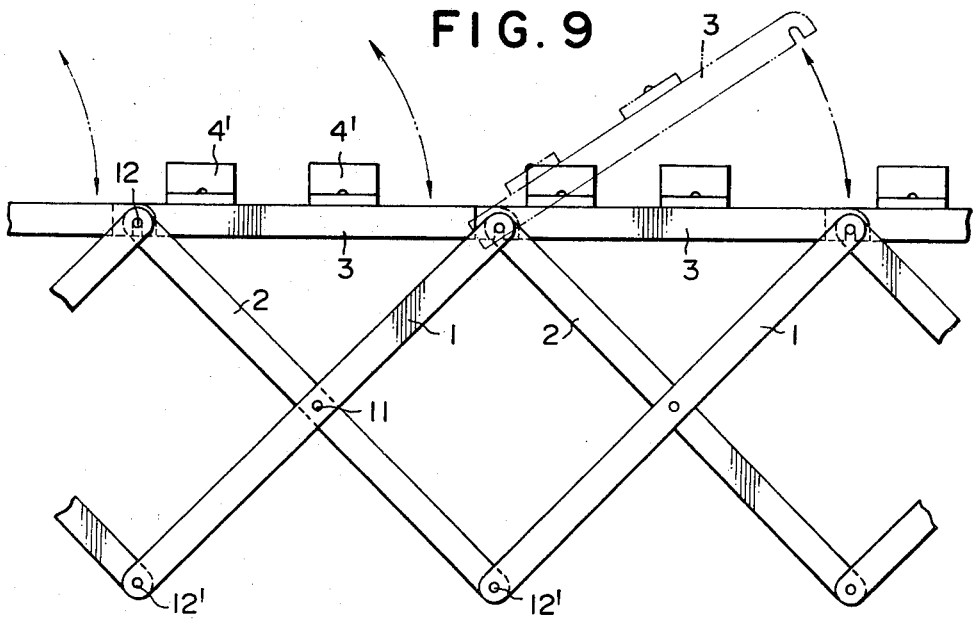
Figure 34:
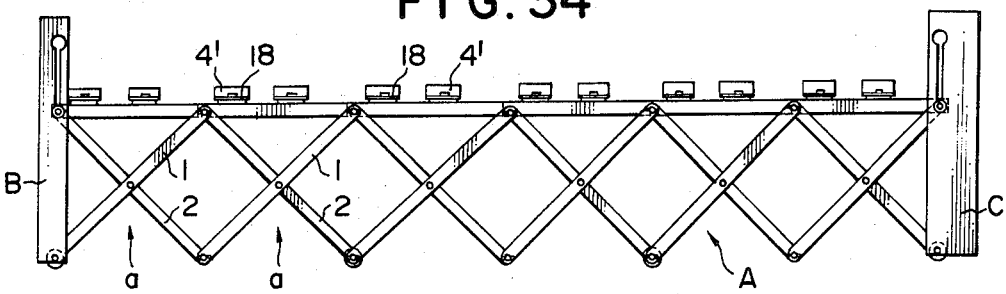
Figure 35:
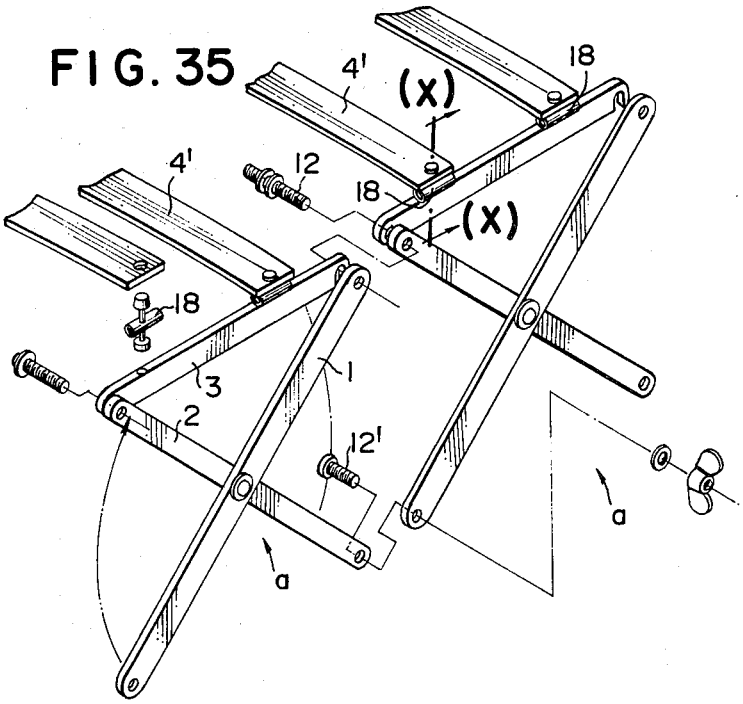

Arms 3, which are respectively mounted on the left and right side legs, are spanned by planar mounting plates 4 on which mats 5 are mounted in order to assemble a bed. Mounting plates 4', which are shown in FIGS. 7–9, are preferably made of plywood or steel plate material and are formed with an upward bulge along their middle portions, as viewed between the side legs. This allows the plates to be vertically elastic. Forming the mounting plate in this fashion provides a bed having satisfactory cushioning features. As hereinafter described in greater detail, elastic member 18 may be interposed between mounting plates 4' and arms 3 to improve the cushioning of the bed as best illustrated in FIGS. 34 and 35.

Figure 10:
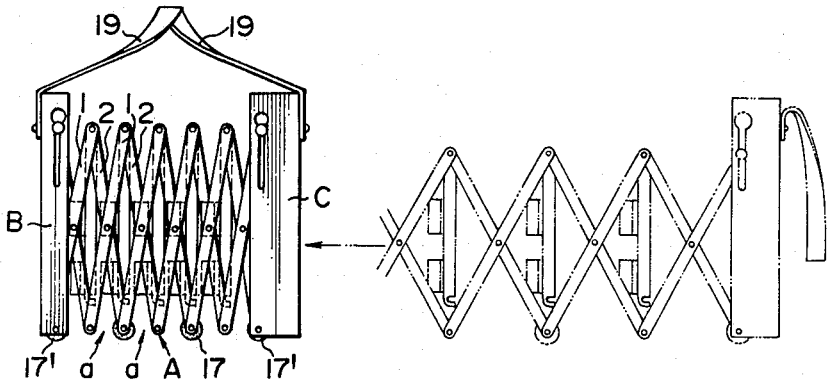

FIG. 10 shows the bed when in its inoperative, contracted position. In this bed position the side legs A and A' are contracted so that the bed can be held in a suitable indoor area or stored in a vehicle, e.g. an automobile. When the bed is stored, each arm 3 is released from its latched state so that either or both of the front and rear upstanding frame plates are urged inwardly to contract each of the X-shaped expanded support legs (a) comprising the side legs into I-shaped legs. This permits easy transportation of the device using carrying handles 19.

Figure 13:
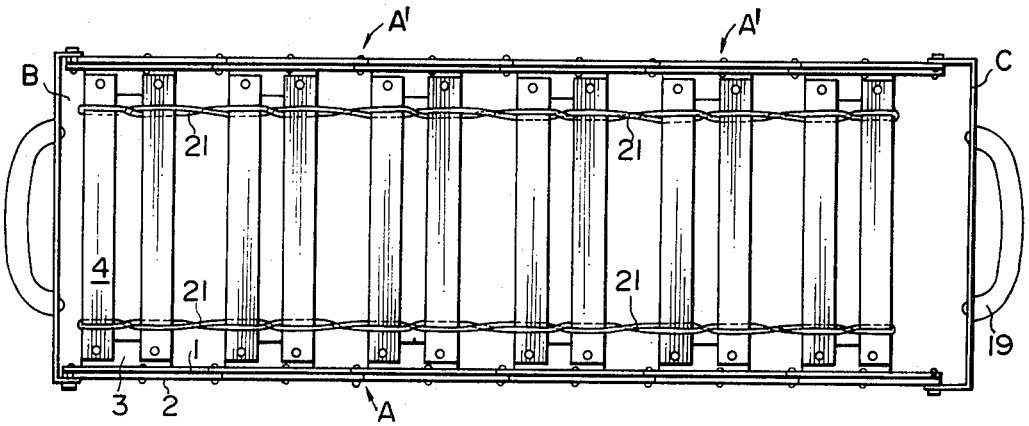
FIGS. 13–15 show a fifth embodiment of the bed, FIG. 13 being a top plan view, FIG. 14 a side plan view and FIG. 15 a side plan view of the bed being contracted into its inoperative, contracted position.
Figure 14:
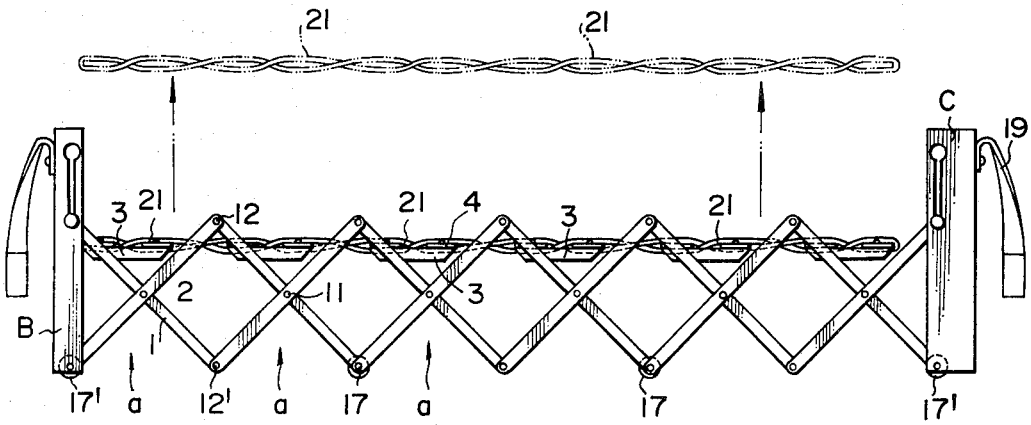
Figure 15:
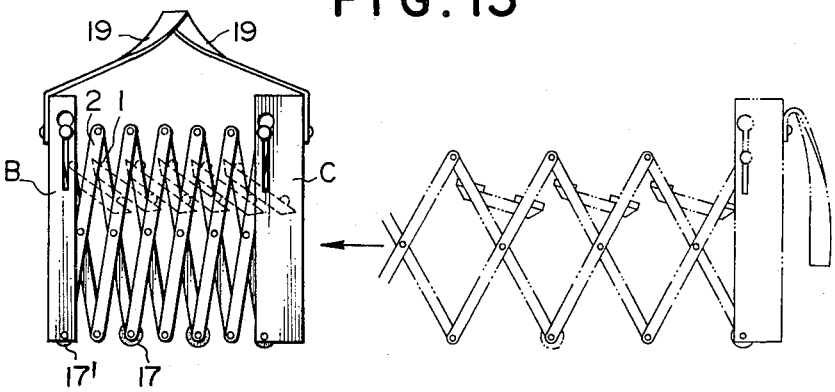

FIGS. 13–15 illustrate mounting plates 4 which are knit and connected to each other by strings 21 along the left and right ends of the plates. In this fashion, mounting plates 4 can be mounted on arms 3 without being fixedly secured thereto, and may be folded neatly by themselves. Further, the bed frame can be separated from mounting plates 4 so that the frame can be more simply transported when in its contracted position, as illustrated in FIG. 14.

Figure 16:
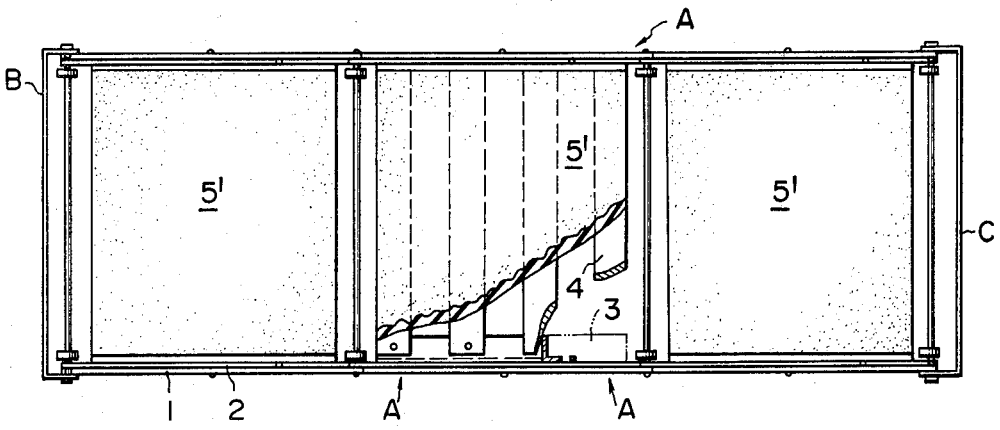
FIGS. 16–18 show a sixth embodiment of the bed, FIG. 16 being a partially cutaway top plan view, FIG. 17 a side plan view and FIG. 18 a side plan view of the bed being contracted into its inoperative, contracted position.
Figure 17:
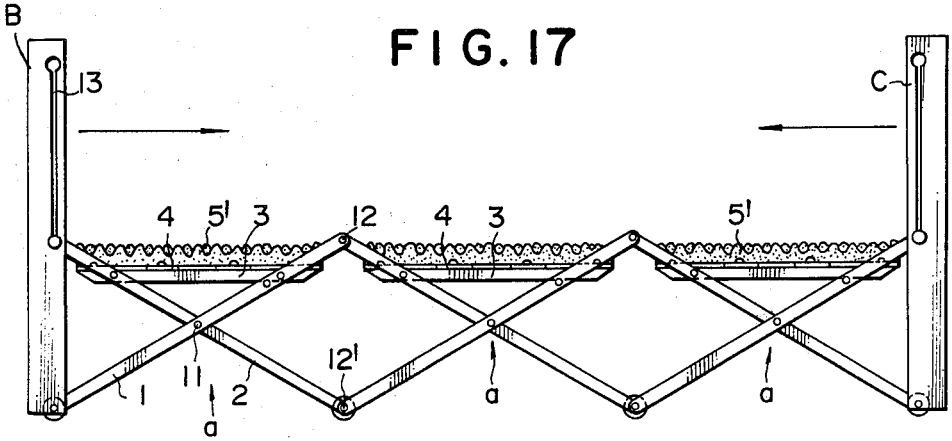
Figure 18:
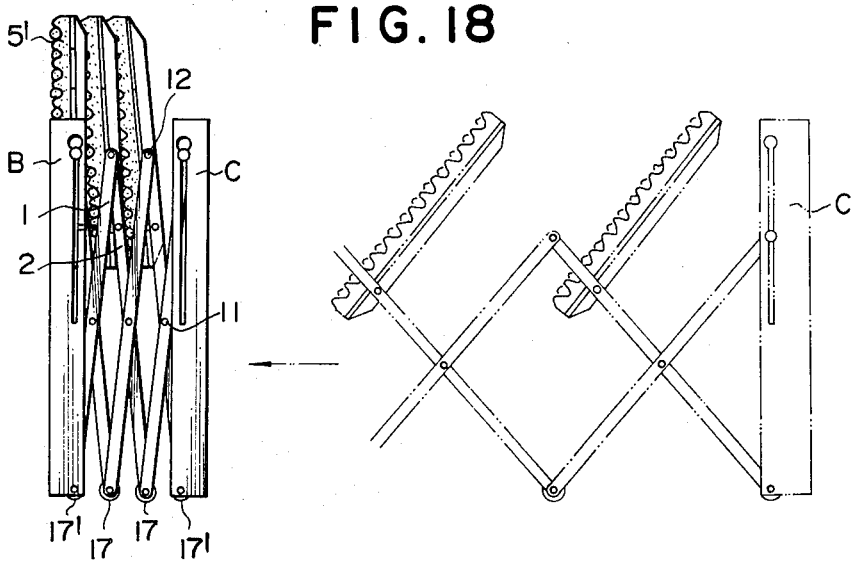

FIGS. 16–18 show spongy mats 5' provided over their entire surface with irregularities. The mat is fixedly attached to mounting plate 14. This simple bed construction occupies only a small space and facilitates handling of the bed both before and after use.

Figure 19:
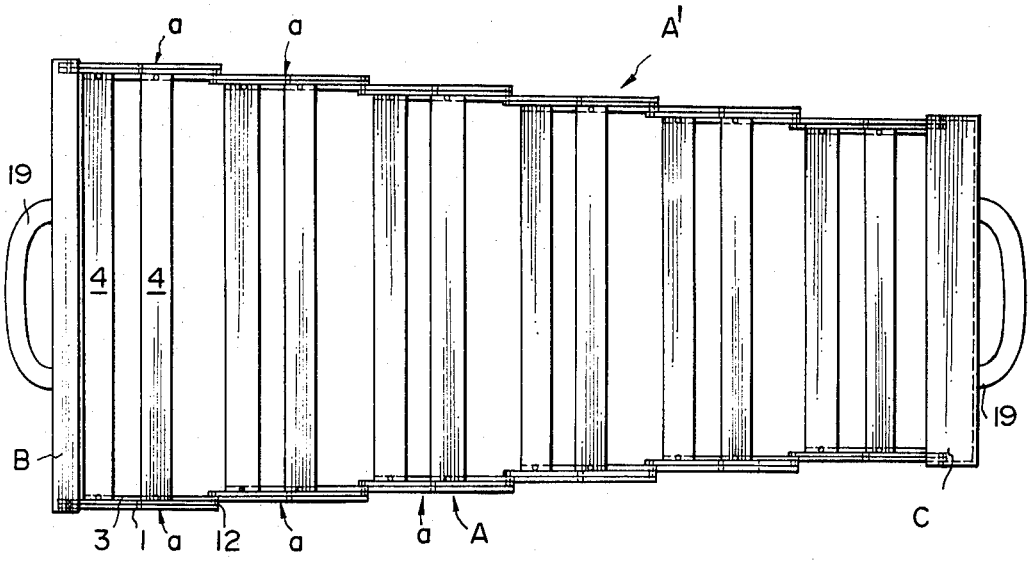
FIGS. 19–22 show a seventh embodiment of the bed, FIG. 19 being a top plan view, FIG. 20 a side plan view, FIG. 21 a longitudinal sectional side view of the bed when in its inoperative, contracted position and FIG. 22 a transverse cross sectional view of the bed when contracted.
Figure 20:
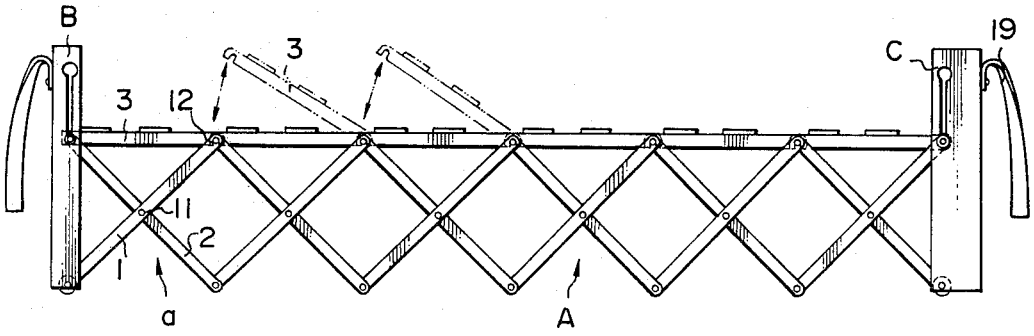
Figure 21:
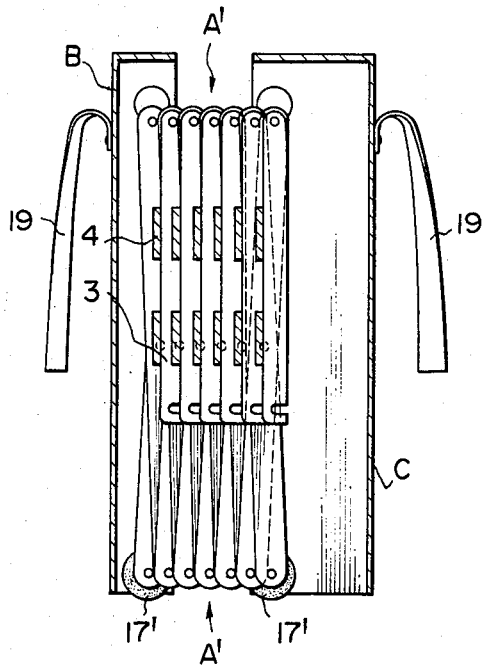
Figure 22:
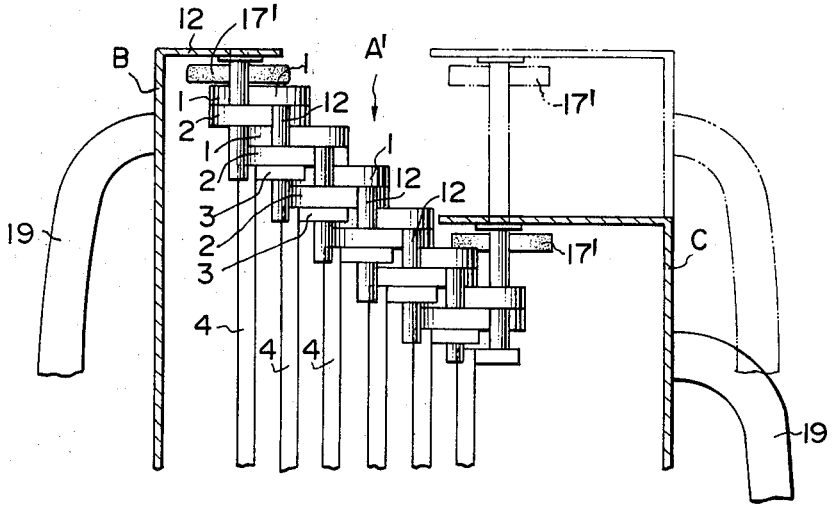

FIGS. 19 and 20 show a bed which is shorter in the longitudinal direction when contracted than the other beds shown. Pins 12 and 12' interconnect X-shaped support legs (a) which comprise side legs A and A' such that each of the support legs is located inside the immediately preceding longitudinal leg, taken in a direction toward rear upstanding frame plate C. Thus, as shown in FIG. 22, connecting pins 12 and 12' have an elongated length such that pin 12 projects from support link 1 to interconnect with an adjacent support link 2 and arm 3. This arrangement provides space for the thickness of the support links and each pin has an end portion which engages arm 3. When the side legs A and A' are contracted, the respective support legs (a) comprising the side legs collapse with each support being positioned inside an adjacent leg, thereby substantially shortening the total length of the support leg and the folded bed in its contracted position. The width of each pair of mounting plates increases as taken in the direction of front upstanding frame plate B; such an arrangement facilitates the placement of supports within each other as well as the contraction of the bed.

Figure 23:
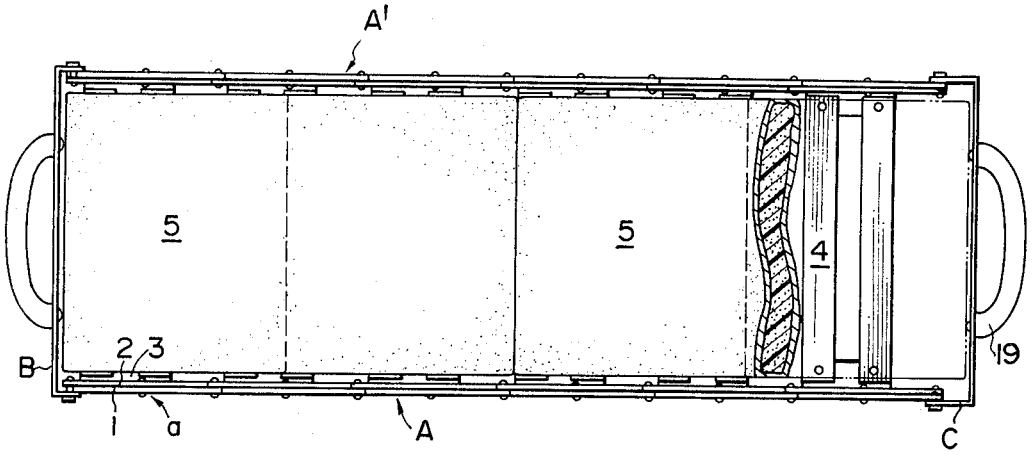
FIGS. 23–26 show an eighth embodiment of the bed, FIG. 23 being a partially cutaway top plan view, FIG. 24 a side plan view, FIG. 25 a side plan view of the bed being contracted into its inoperative, contracted position and FIG. 26 a perspective view of the bed.
Figure 24:
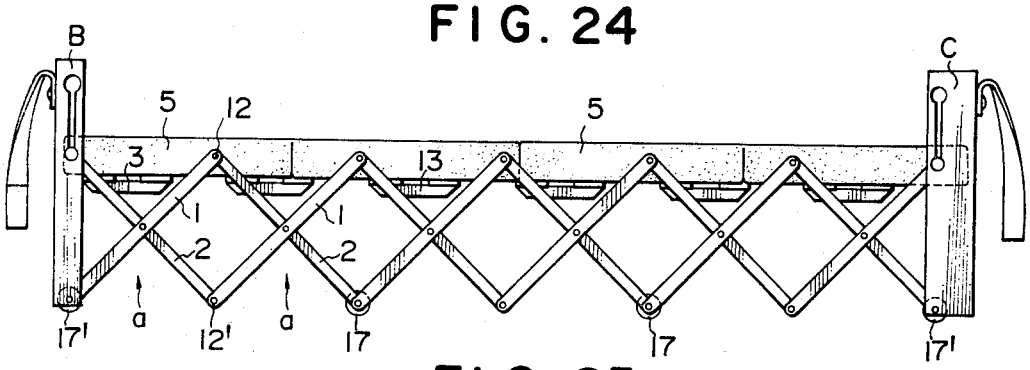
Figure 25:
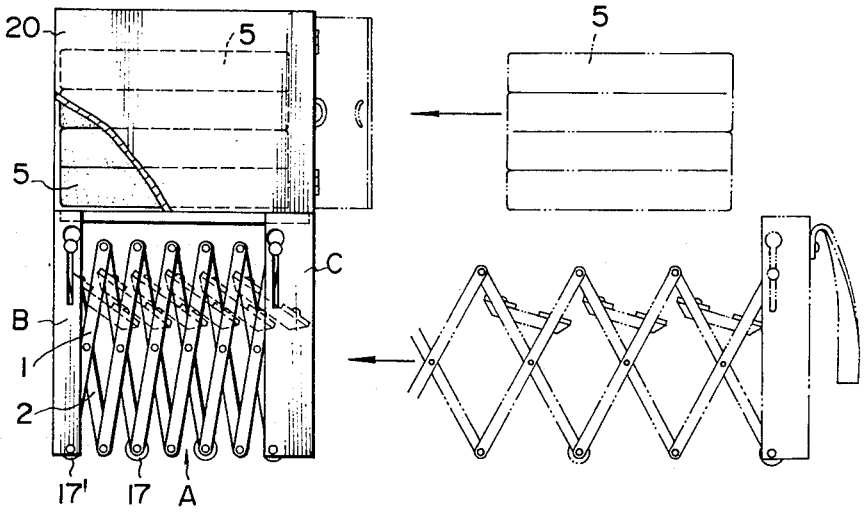
Figure 26:
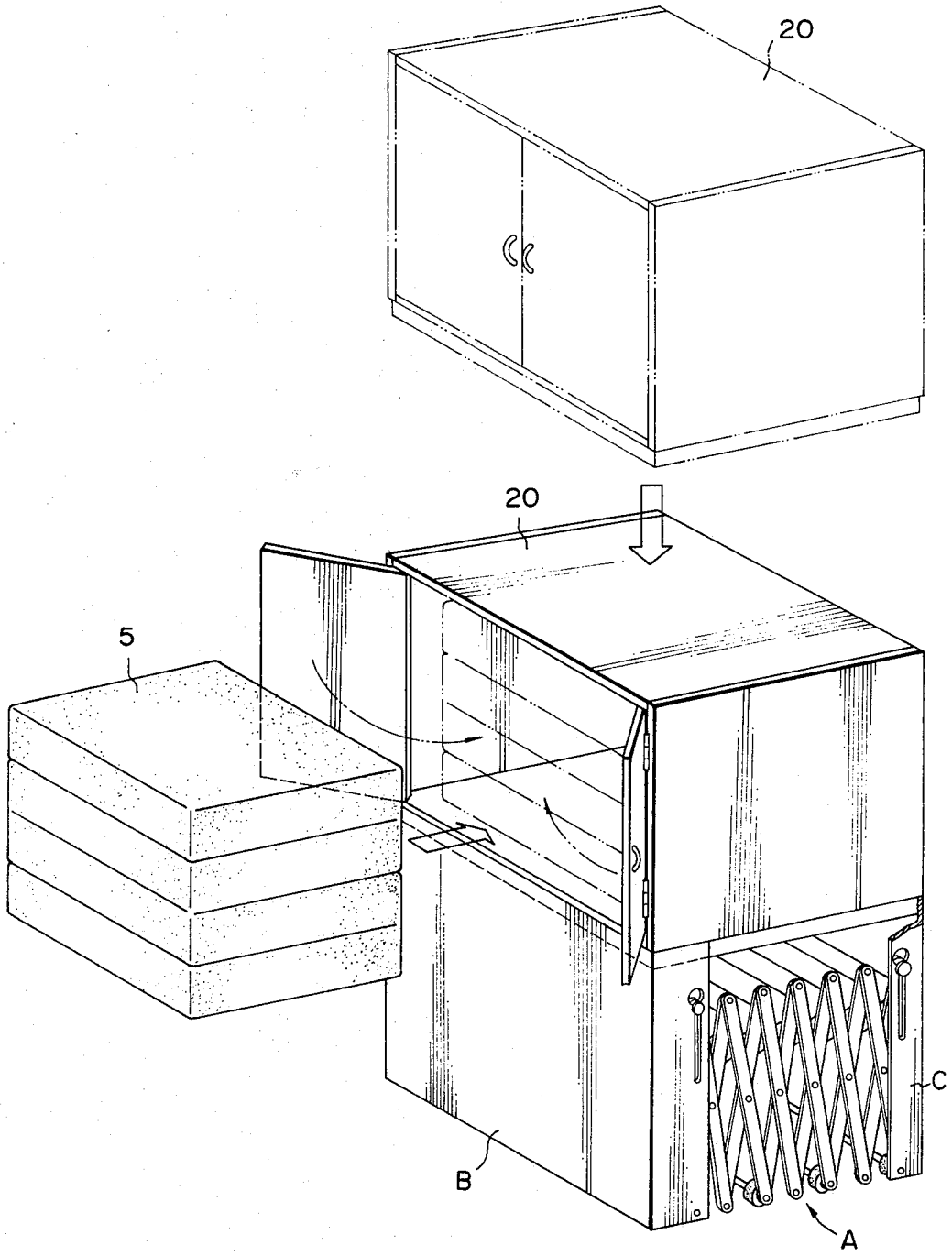

FIGS. 23–26 show mats 5 housed when the bed is in its inoperative position. As illustrated in FIGS. 23 and 24, a plurality of separated mats 5 mounted on respective mounting plates 4 are housed in cabinet 20. This cabinet can be mounted on a contracted bed frame when the mats are not used, as seen in FIGS. 25 and 26, or the cabinet 20 may be integrally fixed to rear upstanding frame plate C. Such an arrangement permits the mat to be neatly and attractively housed without marring the appearance of the surroundings in which they are placed when not in use.

Figure 27:
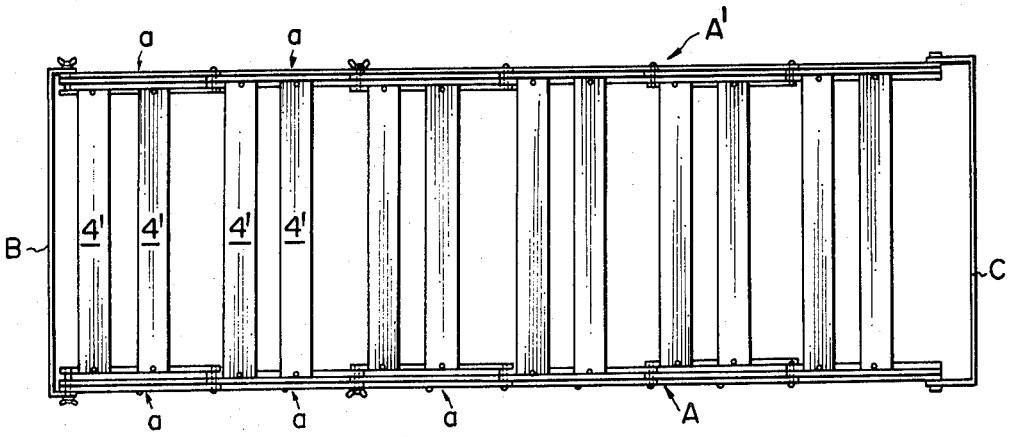
FIGS. 27–29 show a ninth embodiment of the bed, FIG. 27 being a top plan view, FIG. 28 a side plan view and FIG. 29 a side plan view of the bed having an inclined front position.
Figure 28:
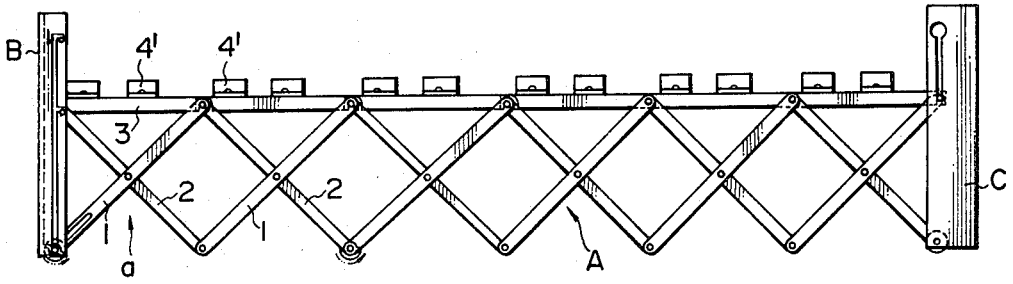
Figure 29:
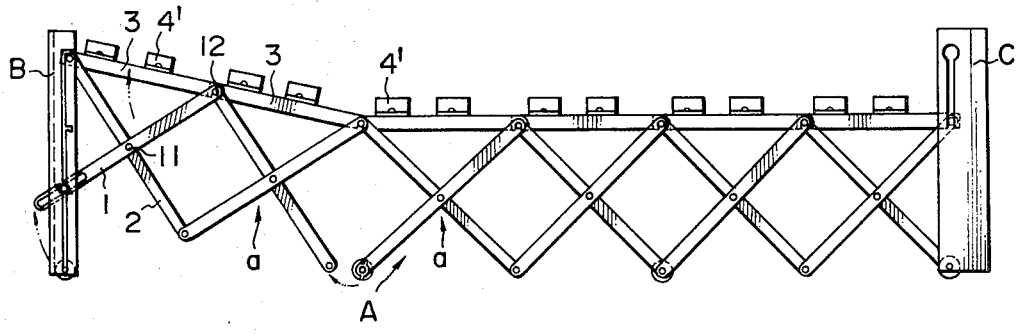

FIGS. 27–29 show side legs A and A' along the front frame plate B side of the frame. These legs are capable of being inclined upwardly. The interconnected lower portions of the left and right side legs A and A' adjacent to upstanding frame plate B are formed separably, while the ends of support links 1 and 2 which are mounted on the frame plate B can be vertically moved along a track or slot in the frame. By separably and detachably connecting the lower portions of the side legs, the front portion of the bed frame can be inclined upwardly when it is used and a user can lie on the bed with the upper half of his body being inclined in order to more conveniently read.

Figure 30:
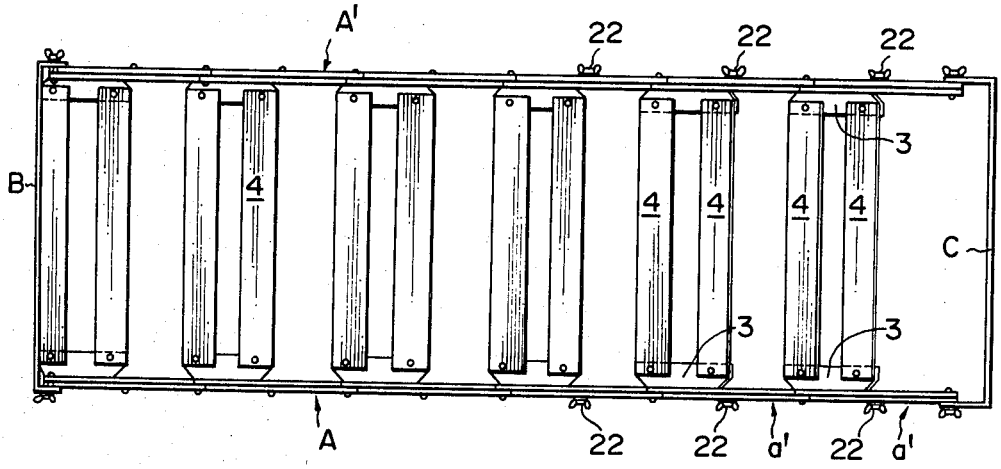
FIGS. 30–32 show a tenth embodiment of the bed, FIG. 30 being a top plan view, FIG. 31 a side plan view and FIG. 32 a side plan view of the bed when in its inoperative, contracted position.
Figure 31:
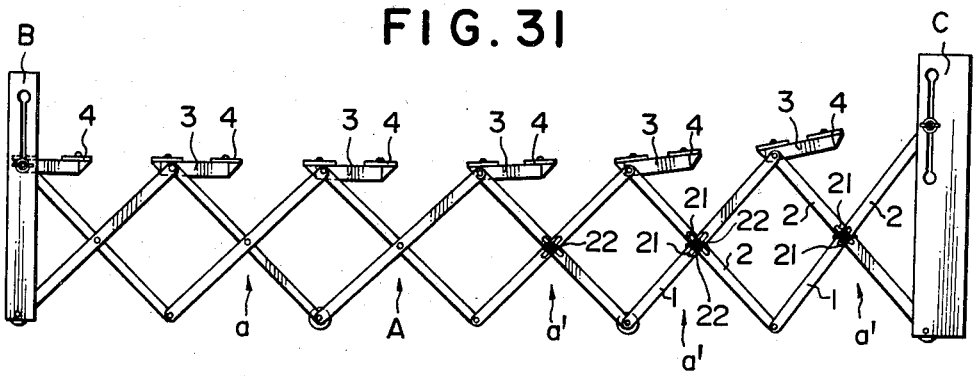
Figure 32:
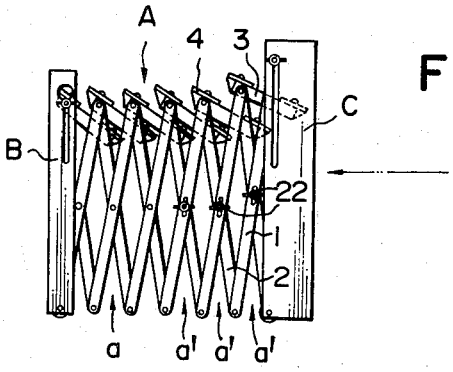

FIGS. 30–32 show a bed in which the length of each support leg (a') comprising side legs A and A' is greater than the preceding leg, when taken in the direction of either of the upstanding frame plates, so that the height of each mounting plate 4 on which a mat is mounted upon the upper ends of these legs is higher as seen in the direction of the desired frame plate. Accordingly, slots 21 provided along portions of the interconnecting support links 1 and 2 allows the legs to be expansible or contractible in X-shaped or I-shaped manner, respectively. This particularly applies to the legs which are relatively longer, e.g., those adjacent to the predetermined frame plate which is taller than the other frame plate. Although in FIGS. 30–32 it is the rear frame plate which is taller, this need not necessarily be the case. The slotted portions are each fastened together by connecting bolt 22. Further, the upper angular ends of left and right arms 3, upon which mounting plates 4 are mounted, are cut and shaped in order to prevent mats 5 or 5' which are mounted on mounting plates 4 from being unduly worn.

Figure 33:
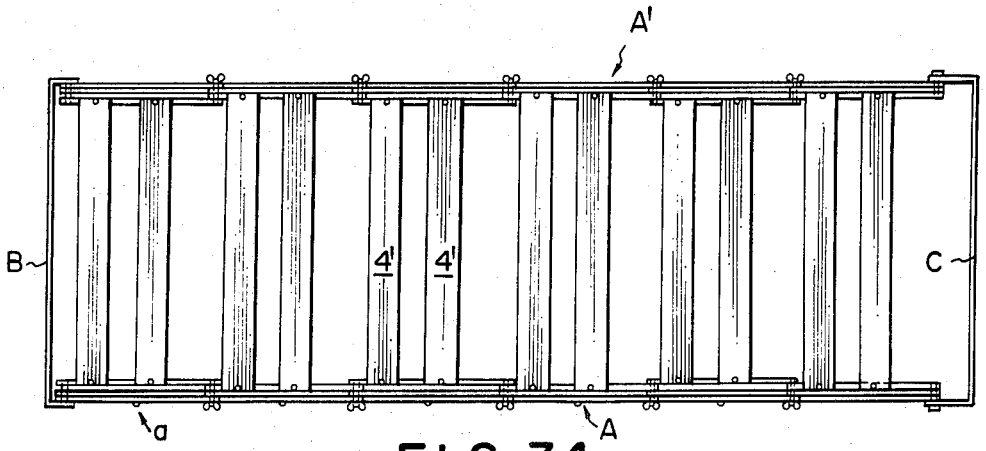
FIGS. 33–37 show an eleventh embodiment of the bed, FIG. 33 being a top plan view, FIG. 34 a side plan view, FIG. 35 an exploded perspective view of the support legs of the bed, FIG. 36 a longitudinal sectional front view taken along lines X—X of FIG. 35 and FIG. 37 a side view of the structure shown in FIG. 36.
Figure 36:
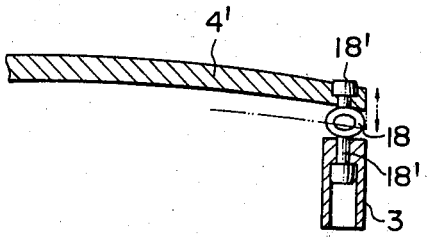
Figure 37:
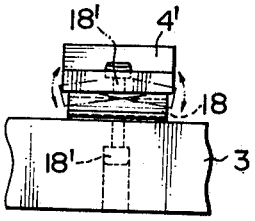
Figure 38:
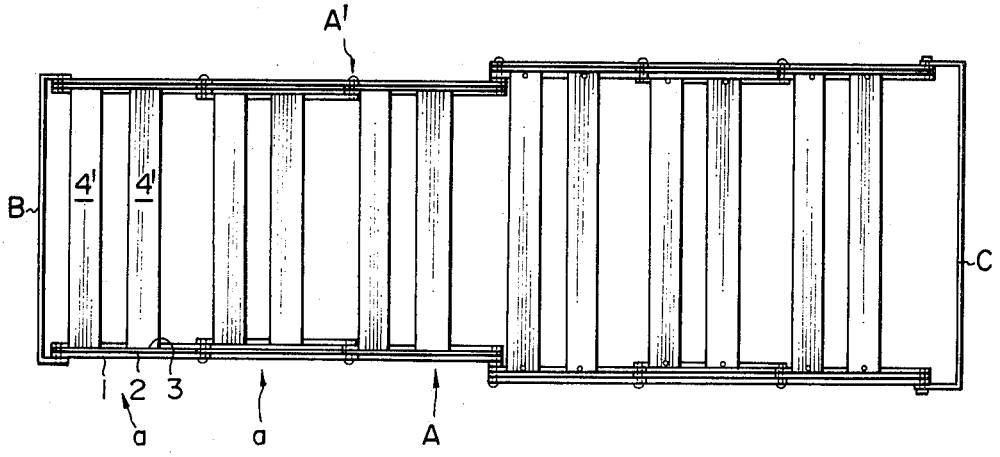
FIGS. 38–41 show a twelth embodiment of the bed, FIG. 38 being a top plan view, FIG. 39 a side plan view, FIG. 40 a plan view of the bed folded upon itself when not in use and FIG. 41 a side plan view of the bed when it is in its contracted, inoperative position.
Figure 39:
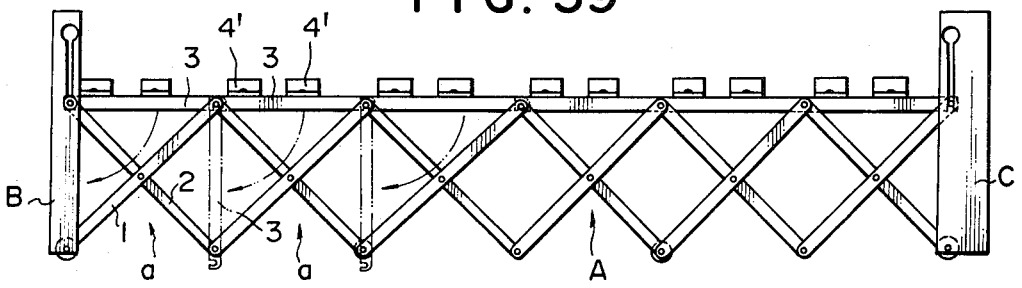
Figure 41:
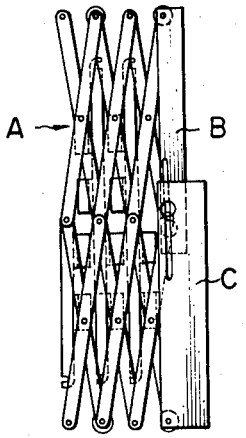
Figure 40:
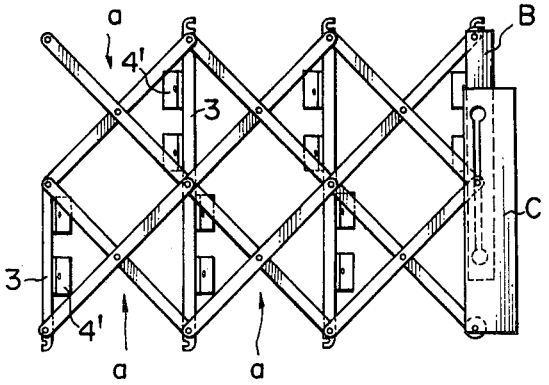

FIGS. 33–35 show a bed in which side legs A and A' are formed from a plurality of separable units which can be conveniently housed and transported when they are not in use. This bed frame, as illustrated in FIGS. 33 and 34, permits support legs (a) comprising the side legs to be separated into independent units while permitting each support leg (a), mounting plate 4' and arm 3 to be independently disassembled, as shown in FIG. 35. Furthermore, cylindrical elastic support members 18 in the drawing include projections 18' on upper and lower portions of their cylindrical bodies. These projections permit members 18 to be mounted removably upon mounting plates 4' and arms 3, respectively, in order to improve the elasticity of mounting plates 4, as shown in FIGS. 36 and 37.

FIGS. 38 through 41 show a bed in which the lower portions of the connections of the left and right side legs A and A' are formed to be separable at the middle of the longitudinal length of the legs so that the front portion of the bed frame can be superposed upon the rear portion of the bed frame when the bed frame is in its inoperative position. In this embodiment, the lateral width of the front portion of the bed frame is smaller than the lateral width of the rear frame portion to insure the superposition of the front portion upon the rear portion when folded. Such a construction permits the longitudinal length of the bed to be half of that of the bed when in use (and before contraction) and aids in substantially reducing the area in which the bed must be received and stored.

Expansion beds constructed according to this invention do not require prior folding of the bed frame achieved by raising, laying and/or pivoting the frame, but instead permit the bed frame to be simply pushed and pulled horizontally, without any force, in order to lift and lower the bed frame so that even frail and elderly people can easily, conveniently and rapidly expand and contract the bed frame into its operative and inoperative positions. Furthermore, the support legs which comprise the left and right side legs of the frames stably contact the floor to provide support for and to disperse any load without deforming the side legs. Since the side legs each comprise a plurality of X-shaped support legs when in expanded condition, each side leg can be installed securely and tightly on the surface of the floor without any fear of deformation. Additionally, since the X-shaped support legs are contractible so as to overlap each other for a distance up to the width of the support links, they can be compactly and easily housed in a cabinet and the like when the bed is not in use. Also, since the arms are pivotably and slideably mounted on the respective support links of the support legs, the side legs can be directed freely in any direction and the mounting plates, mats and similar surfaces can be neatly superposed upon each other with a minimum of bulk. Thus, the volume of the bed frame is not increased when folded so that the space occupation ratio of the bed frame, is not increased. Accordingly, the desired space saving objective of the present invention is achieved.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. An expansion bed comprising a frame having spaced front and rear upstanding frame plates and at least two pairs of support links, the links of each pair of support links being superposed and pivotably secured at a middle portion of said links, each pair of links comprising a support leg which is adapted to be expanded into a generally X-shaped configuration and contracted into a generally L-shaped configuration, said frame including two opposed sides wherein at least one pair of links is positioned on each of said sides, the links on each frame side connecting said front and rear frame plates to each other, each of said links including upper, middle and lower portions, said bed further comprising a plurality of support legs on each frame side, arms supported by and attached to adjacent links, and mounting plates supported by said arms, said arms further including latching notches adapted to latch onto pins projecting inwardly from said support links.

* * * * *

UNITED STATES PATENT AND TRADEMARK OFFICE

CERTIFICATE OF CORRECTION

PATENT NO. : 4,384,379

DATED : May 24, 1983

INVENTOR(S) : Junji YAMADA

It is certified that error appears in the above-identified patent and that said Letters Patent is hereby corrected as shown below:

At column 7, line 3, "L-shaped" should read ---I-shaped---.

Signed and Sealed this

*Twentieth* Day of *September 1983*

[SEAL]

*Attest:*

GERALD J. MOSSINGHOFF

*Attesting Officer*

*Commissioner of Patents and Trademarks*